United States Patent [19]

Crupi et al.

[11] Patent Number: 4,559,922

[45] Date of Patent: Dec. 24, 1985

[54] MACHINE FOR SOFTENING AN ASPHALT ROAD SURFACE

[76] Inventors: Franco A. Crupi, 15 Croxley Green, Markham, Ontario, Canada, L3R 3T5; Christopher Bzowski, 5 Mistflower Rd., Willowdale, Canada, M2H 3G8; Ernest R. Measures, 139 Churchill Ave., Willowdale, Canada, M2N 1Z3

[21] Appl. No.: 656,281

[22] Filed: Oct. 1, 1984

[51] Int. Cl.[4] ..... F23C 5/00

[52] U.S. Cl. ..... 126/271.2 A

[58] Field of Search ..... 126/271.2 A, 271.2 R

[56] References Cited

U.S. PATENT DOCUMENTS 1,899,704 2/1933 Lutz ..... 126/271.2 A 4,213,501 7/1980 Pfeiffer et al. ..... 62/52

FOREIGN PATENT DOCUMENTS 412630 7/1934 United Kingdom ..... 126/271.2 A

*Primary Examiner*—Carroll B. Dority, Jr.

*Attorney, Agent, or Firm*—Robert F. Delbridge; Arne I. Fors

[57] ABSTRACT

A machine for softening an asphalt road surface has a housing with a bottom peripheral wall positionable in engagement with a road surface, a gas heater, ducts for conveying hot gas from the heater to the housing and to the road surface under the housing and for recycling gas from the housing after contact with the road surface to the gas heater for reheating, and a fan for circulating gas through the ducts.

5 Claims, 1 Drawing Figure

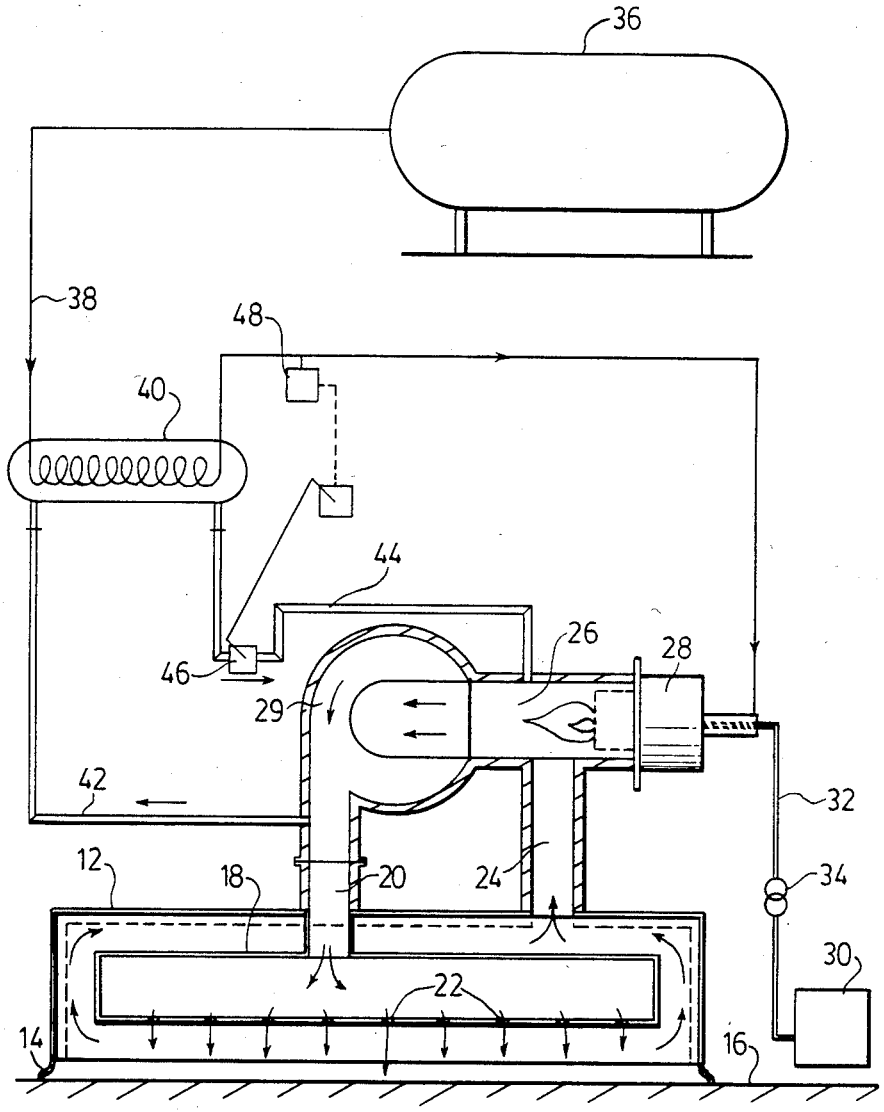
36
38
48
40
44
26
28
46
29
42
32
12
18
20
24
34
30
22
14
16

MACHINE FOR SOFTENING AN ASPHALT ROAD SURFACE

This invention relates to a machine for softening an asphalt road surface during repair or resurfacing.

When repairing or resurfacing an asphalt road surface, it is necessary to soften old asphalt so that a satisfactory bond is formed between the old asphalt and subsequently applied new asphalt.

Known machines for this purpose apply heat to a road surface either by causing flames from a fuel burner assembly to contact the surface or by causing such flames to heat the top surface of a horizontal metal plate positioned just above the road surface so that heat is radiated from the lower surface of the plate onto the road surface. A major problem with such prior techniques is that the combination of the heat applied and the oxygen in the atmosphere tends to oxidized the asphalt and drive off relatively volatile components, thereby causing deterioration of the quality of the asphalt. A consequent effect is the release to the atmosphere of objectionable pollutants, thereby creating a local environmental hazard.

It is therefore an object of the invention to provide an improved asphalt softening machine which at least substantially overcomes these problems.

According to the invention, an asphalt softening machine comprises a housing having a bottom peripheral wall positionable in engagement with a road surface, gas heating means, duct means for conveying hot gas from the gas heating means to the housing and to the road surface under the housing and for recycling gas from the housing after contact with the road surface to the gas heating means for reheating, and fan means for circulating as through the duct means.

Thus, with a machine in accordance with the invention, the asphalt road surface is softened by hot gas which is then recycled to the gas heating means instead of being released to the surrounding atmosphere, with only a minimal amount of hot gas being lost by leakage between the bottom peripheral wall of the housing and the road surface. Also, the gas heating means can be operated in such a manner that the hot gas passed to the housing and into contact with the road surface contains very little oxygen, thereby minimizing oxidation of the asphalt.

The housing may contain a plenum chamber for receiving hot gas from the gas heating means, the plenum chamber having a bottom wall with apertures through which hot gas passes from the plenum chamber into contact with the road surface.

The gas heating means may comprise a fluid fuel burner having a combustion chamber in communication with the duct means. The burner may be operable to burn liquid and gaseous fuel. The burner may be a gaseous fuel burner, with the machine also including a liquid fuel supply and means for vapourizing the liquid fuel for supply to the burner. The vapourizing means may comprise hot gas from the duct means.

The fan means may be located in the duct means carrying hot gas from the gas heating means to the housing. The bottom peripheral wall of the housing may comprise a flexible skirt engageable with the road surface.

One embodiment of the invention will now be described, by way of example, with reference to the accompanying drawing which shows a schematic diagram of an asphalt softening machine.

Referring to the drawing, an asphalt softening machine comprises a box-like housing 12 which is open at its lower end, the bottom peripheral wall 14 of the housing 12 being formed by a flexible skirt 14 which in use engages an asphalt road surface 16. It will of course be understood by a person skilled in the art that in practice the machine will be carried by a wheeled vehicle such that the machine can be moved along a road being repaired or resurfaced. The housing 12 contains a hot gas plenum chamber 18 which receives hot gas from a duct 20, the bottom wall of the plenum chamber 18 having apertures 22 (which if desired may be adjustable in size) through which hot gas passes from the plenum chamber 18 into contact with the road surface 16. The plenum chamber 18 is spaced from the walls of the housing 12 so that, after engagement with the road surface 16, the gas can pass between the exterior of the plenum chamber 18 and the walls of the housing 12 and leave the housing 12 through a duct 24.

The duct 24 leads from the housing 12 into the combustion chamber 26 of a fluid fuel burner 28 which is operable to burn oil and/or propane gas. A high temperature recirculation fan 29 is located between the combustion chamber 26 and the duct 20. Oil can be supplied to the burner 28 from an oil tank 30 through an oil supply line 32 incorporating an oil pump 34. Propane gas can be supplied to the burner 28 from a liquid propane storage tank 36 through a propane supply line 38 incorporating a vapourizer 40. The liquid propane is converted to gaseous propane in the vapourizer 40 by gas bled from the duct 20 through line 42 and subsequently returned through line 44 to combustion chamber 26. The vapourizer 40 is controlled by valve 46 in line 44 and responds in known manner to the degree of vapourization detected by a sensor 48 in line 38 downstream of the vapourizer 40.

In use, the burner 28 is operated with propane and/or oil fuel to produce a flame in the combustion chamber 26 with just sufficient oxygen being admitted to effect combustion of the fuel. The high temperature recirculation fan 20 may be powered by a hydraulic motor (not shown) and is constructed to withstand gas temperatures of 1800° F. (about 1000° C.) this being a suitable gas temperature produced by the burner 28. The housing 12 may typically have dimensions of about 12 feet wide, 20 feet long and 3 feet high (i.e. about 4 meters wide, 7 meters long and 1 meter high). With such housing dimensions, the fan 29 is conveniently constructed to produce a flow of about 15,000 scfm.

The fan 29 draws gas from the housing 12 through the duct 24 and into the combustion chamber 26, and drives the hot gas from the combustion chamber 26 through fan 29 and the duct 20 into the plenum chamber 18 from which the hot gas is directed from apertures 22 onto the road surface at high velocity and temperature to soften the asphalt. The high temperature, high velocity gas engages the road surface 16 in a turbulent manner and in effect produces a scrubbing action in softening the asphalt. This enables asphalt to be softened to a depth of about 2 inches (5 cm) in about 1 minute.

Except for a minor amount of leakage from the housing 12 to the atmosphere between the flexible skirt 14 and the road surface 16, the hot gas is continually recirculated and reheated, the gas leaving the housing 12 through the duct 24 probably having a temperature of about 1200° F. (about 650° C.). There is thus substantially no loss of hot gas (and thus heat) to the surrounding environment although about 5 to 10% of combustion air used by the burner 29 may be vented off to maintain a desired pressure in the system so as to reduced the likelihood of gas loss from the housing 12 between the flexible skirt 14 and the road surface 16. The burner 28 can readily be operated with a fresh air intake just sufficient to effect combustion of the fuel, so that the hot gas supplied to the asphalt road surface may be substantially free of oxygen (i.e. less than about 2%), with there subsequently being substantially no oxidation of the asphalt being softened. It will also be noted that any fumes produced by softening the asphalt will be incinerated in the combustion chamber 26.

Other embodiments of the invention will be readily apparent to a person skilled in the art, the scope of the invention being defined in the appended claims.

What we claim as new and desire to protect by Letters Patent of the United States is:

1. A machine for softening an asphalt road surface comprising:

a housing having a bottom peripheral wall positionable in engagement with a road surface, gas heating means, the housing containing a plenum chamber for receiving hot gas from the gas heating means, said plenum chamber having a bottom wall with apertures through which hot gas passes from the plenum chamber into contact with the road surface, duct means for conveying hot gas from the gas heating means to the plenum chamber and for recycling gas from the housing after contact with the road surface to the gas heating means for reheating, and fan means for circulating gas through the duct means.

2. A machine according to claim 1 wherein the gas heating means comprises a fluid fuel burner having a combustion chamber in communication with the duct means.

3. A machine according to claim 2 wherein the burner is operable to burn liquid and/or gaseous fuel.

4. A machine according to claim 1 wherein the fan means is located in the duct means carrying hot gas from the gas heating means to the housing.

5. A machine according to claim 1 wherein the bottom peripheral wall of the housing comprising a flexible skirt engageable with the road surface.

* * * * *